US010319342B2

(12) United States Patent
Li et al.

(10) Patent No.: US 10,319,342 B2
(45) Date of Patent: Jun. 11, 2019

(54) METHOD AND DEVICE FOR ADJUSTING DISPLAY BRIGHTNESS

(71) Applicant: Xiaomi Inc., Beijing (CN)

(72) Inventors: Guosheng Li, Beijing (CN); Anyu Liu, Beijing (CN); Hui Du, Beijing (CN)

(73) Assignee: XIAOMI INC., Beijing (CN)

( * ) Notice: Subject to any disclaimer, the term of this patent is extended or adjusted under 35 U.S.C. 154(b) by 56 days.

(21) Appl. No.: 15/393,420

(22) Filed: Dec. 29, 2016

(65) Prior Publication Data

US 2017/0110092 A1 Apr. 20, 2017

Related U.S. Application Data

(63) Continuation of application No. PCT/CN2015/093404, filed on Oct. 30, 2015.

(30) Foreign Application Priority Data

Jan. 15, 2015 (CN) ..... 2015 1 0020861

(51) Int. Cl.
*G09G 3/20* (2006.01)
*G09G 3/34* (2006.01)
*G09G 5/10* (2006.01)

(52) U.S. Cl.
CPC ..... *G09G 5/10* (2013.01); *G09G 3/20* (2013.01); *G09G 3/2003* (2013.01); *G09G 3/34* (2013.01);
(Continued)

(58) Field of Classification Search
CPC ..... G09G 5/10; G09G 3/20; G09G 3/2003; G09G 3/34; G09G 2320/0626;
(Continued)

(56) References Cited

U.S. PATENT DOCUMENTS

2007/0035489 A1* 2/2007 Lee ..... G09G 3/3233 345/77
2010/0277516 A1 11/2010 Kimura
(Continued)

FOREIGN PATENT DOCUMENTS

CN 101021639 A 8/2007
CN 101162565 A 4/2008
(Continued)

OTHER PUBLICATIONS

Office Action dated Nov. 14, 2017 for Japanese Application No. 2017-505078, 9 pages.
(Continued)

*Primary Examiner* — Alexander Eisen
*Assistant Examiner* — Kebede T Teshome
(74) *Attorney, Agent, or Firm* — Brinks Gilson & Lione

(57) ABSTRACT

The present disclosure relates to methods and devices for adjusting display brightness. A method may include determining original gray scale values of pixels of a display. The method may further include performing gray scale transformation on the original gray scale values of the pixels of the display to determine transformed gray scale values. The method may further include adjusting gray scale values of the pixels of the display to the transformed gray scale values.

25 Claims, 14 Drawing Sheets

(52) U.S. Cl.
CPC ..... *G09G 2320/0271* (2013.01); *G09G 2320/0285* (2013.01); *G09G 2320/066* (2013.01); *G09G 2320/0626* (2013.01); *G09G 2320/0686* (2013.01); *G09G 2360/144* (2013.01); *G09G 2360/16* (2013.01)

(58) Field of Classification Search
CPC ..... G09G 2320/0686; G09G 2320/066; G09G 2320/0271; G09G 2320/0285
See application file for complete search history.

(56) References Cited

U.S. PATENT DOCUMENTS

| | | | | |
|---|---|---|---|---|
| 2011/0205397 | A1 | 8/2011 | Hahn et al. | |
| 2013/0044146 | A1 | 2/2013 | Kurokawa et al. | |
| 2014/0140615 | A1* | 5/2014 | Finlayson | G06T 5/009 382/167 |
| 2014/0232709 | A1 | 8/2014 | Dunn et al. | |
| 2015/0070337 | A1* | 3/2015 | Bell | G09G 3/2003 345/207 |
| 2015/0116387 | A1* | 4/2015 | Jun | G09G 3/20 345/694 |

FOREIGN PATENT DOCUMENTS

| | | | |
|---|---|---|---|
| CN | 101251985 | A | 8/2008 |
| CN | 101271208 | A | 9/2008 |
| CN | 101673515 | A | 3/2010 |
| CN | 101271208 | B | 4/2010 |
| CN | 102750927 | A | 10/2012 |
| CN | 103810973 | A | 5/2014 |
| CN | 104700786 | A | 6/2015 |
| EP | 0 883 103 | A1 | 12/1998 |
| JP | H08-16129 | A | 1/1996 |
| JP | 2002-221950 | A | 8/2002 |
| JP | 2009-031554 | A | 2/2009 |
| JP | 2009-294292 | A | 12/2009 |
| JP | 2010-107535 | A | 5/2010 |
| JP | 2012-194404 | A | 10/2012 |
| RU | 2 463 673 | C2 | 10/2012 |

OTHER PUBLICATIONS

Translation of International Search Report dated Jan. 21, 2016 in corresponding international application PCT/CN2015/093404, filed Oct. 30, 2015, 3pp.
Extended European Search Report dated Aug. 30, 2017 for European Application No. 15862147.4, 16 pages.
Office Action dated Jan. 22, 2018 for Russian Application No. 2017102530/08, 8 pages.
Office Action dated Aug. 3, 2016 for Chinese Application No. 201510020861.0, 13 pages.
Report of Reconsideration by Examiner before Appeal dated Oct. 3, 2018 for Japanese Application No. 2017-505078, 6 pages.
Office Action dated Mar. 28, 2019 for Indian Application No. 201647033642, 6 pages.

* cited by examiner

METHOD AND DEVICE FOR ADJUSTING DISPLAY BRIGHTNESS

CROSS-REFERENCE TO RELATED APPLICATIONS

This application is a continuation application of International Application No. PCT/CN2015/093404, filed on Oct. 30, 2015 with the State Intellectual Property Office of the People's Republic of China, which is based on and claims priority to Chinese Patent Application No. 201510020861.0, filed on Jan. 15, 2015, wherein the entire contents of each of the aforementioned applications are hereby incorporated herein by reference.

TECHNICAL FIELD

The present disclosure generally relates to the field of image processing, and more particularly, to methods and devices for adjusting display brightness.

BACKGROUND

In daily life, many people have a habit of using a smart device (such as a mobile phone) before falling asleep. If, at such a time, ambient lights are turned on, power may be wasted and other people may be affected. If ambient lights are not turned on, in order to use the mobile phone in an environment with extremely low brightness (such as at nighttime with an exemplary brightness of 0.001 lux), most people choose to decrease the brightness of the mobile phone. However, because the display brightness is constrained by the LCD backlight circuit, structure, control mode, and cost, it is difficult to achieve extremely low display brightness. The inability to achieve an extremely low display brightness may cause great damage to the eyes when using the mobile phone in a very dark environment (such as at nighttime with an exemplary brightness of 0.001 lux).

SUMMARY

The present disclosure provides methods and devices for adjusting display brightness.

In a first aspect of embodiments of the present disclosure, there is provided a method for adjusting display brightness. The method may include determining original gray scale values of pixels of a display. The method may further include performing gray scale transformation on the original gray scale values of the pixels of the display to determine transformed gray scale values. The method may further include adjusting gray scale values of the pixels of the display to the transformed gray scale values.

In a second aspect of embodiments of the present disclosure, there is provided a device for adjusting display brightness. The device may include a processor and a memory configured to store instructions executable by the processor. The processor may be configured to determine original gray scale values of pixels of a display. The processor may be further configured to perform the gray scale transformation on the original gray scale values of the pixels of the display to determine transformed gray scale values. The processor may be further configured to adjust gray scale values of the pixels of the display to the transformed gray scale values.

According to a third aspect of embodiments of the present disclosure, there is provided a non-transitory computer-readable storage medium having stored therein instructions for adjusting display brightness. The instructions may be configured to, when executed by a processor of a device, cause the device to determine original gray scale values of pixels of a display. The instructions may be further configured to, when executed by a processor of the device, cause the device to perform gray scale transformation on the original gray scale values of the pixels of the display to determine transformed gray scale values. The instructions may be further configured to, when executed by a processor of the device, cause the device to adjust gray scale values of the pixels of the display to the transformed gray scale values.

Technical solutions provided in embodiments of the present disclosure may have the following advantageous effects. In environments with extremely low brightness, the display system may automatically operate at an extremely low brightness setting, such that damage to a user's eyes may be decreased, and the display system may adapt to environments that have low brightness because a separate illumination device is not being used. The effects of the system may apply to all displayed content rather than merely for some specific applications. Thus, it may be unnecessary to develop separate respective night modes for each application, which may provide that the size of resource files may be reduced, storage space may be saved, the system is easy to implement, and user satisfaction is high.

It is to be understood that both the foregoing general description and the following detailed description are merely exemplary and explanatory, and are not intended to limit the present disclosure.

BRIEF DESCRIPTION OF THE DRAWINGS

The accompanying drawings, which are incorporated in and constitute a part of this specification, illustrate embodiments consistent with the present disclosure and, together with the description, serve to explain the principles of the present disclosure.

DETAILED DESCRIPTION

Reference will now be made in detail to exemplary embodiments, examples of which are illustrated in the accompanying drawings. The following description refers to the accompanying drawings, in which the same numbers in different drawings represent the same or similar elements unless otherwise noted. The implementations set forth in the following description of exemplary embodiments do not represent all implementations consistent with the disclosure. Instead, they are merely examples of apparatuses and methods consistent with aspects related to the disclosure and the appended claims.

Reference throughout this specification to "one embodiment," "an embodiment," "exemplary embodiment," or the like in the singular or plural means that one or more particular features, structures, or characteristics described in connection with an embodiment is included in at least one embodiment of the present disclosure. Thus, the appearances of the phrases "in one embodiment" or "in an embodiment," "in an exemplary embodiment," or the like in the singular or plural in various places throughout this specification are not necessarily all referring to the same embodiment. Furthermore, the particular features, structures, or characteristics in one or more embodiments may be combined in any suitable manner.

The terminology used in the description of the disclosure herein is for the purpose of describing particular examples only and is not intended to be limiting of the disclosure. As used in the description of the disclosure and the appended claims, the singular forms "a," "an," and "the" are intended to include the plural forms as well, unless the context clearly indicates otherwise. Also, as used in the description herein and throughout the claims that follow, the meaning of "in" includes "in" and "on" unless the context clearly dictates otherwise. It will also be understood that the term "and/or" as used herein refers to and encompasses any and all possible combinations of one or more of the associated listed items. It will be further understood that the terms "may include," "including," "comprises," and/or "comprising," when used in this specification, specify the presence of stated features, operations, elements, and/or components, but do not preclude the presence or addition of one or more other features, operations, elements, components, and/or groups thereof.

In embodiments of the present disclosure, by changing gray scale values of a display interface when the brightness is extremely low, an objective of not hurting the eyes while not affecting the image quality may be achieved.

Figure 1:
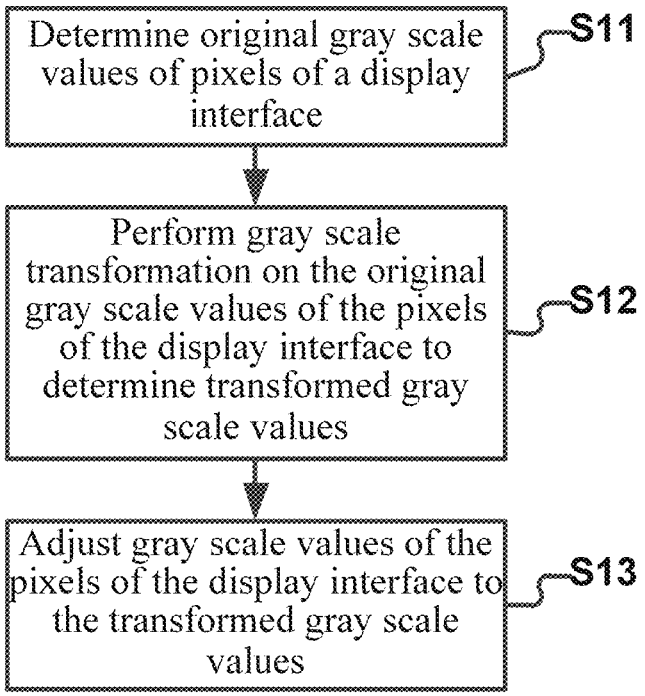
FIG. 1 is a flow chart showing a method for adjusting display brightness according to an example embodiment of the present disclosure.

FIG. 1 is a flow chart showing a method for adjusting display brightness according to an example embodiment of the present disclosure. As shown in FIG. 1, the method for adjusting display brightness may be applied in a terminal and may include the following steps.

In step S11, original gray scale values of pixels of a display interface are determined.

In step S12, gray scale transformation is performed on the original gray scale values of the pixels of the display interface to determine transformed gray scale values.

In step S13, gray scale values of the pixels of the display interface are adjusted to the transformed gray scale values.

In this embodiment, by adjusting the gray scale values of the display interface, the brightness and contrast ratio of the display interface may be changed, such that, when the ambient brightness is low, the decreased gray scale values may reduce the backlight transmittance of the display interface, and thus the brightness and contrast ratio of the display interface may be decreased significantly, thus achieving an objective of protecting eyesight of the user using the screen. Also, because, in an environment with low brightness, image quality is less affected by a decline of brightness and contrast ratio of the display interface, the required image quality of the user may be satisfied, such that the power consumption of the terminal may be reduced while the user satisfaction is high.

Figure 2:
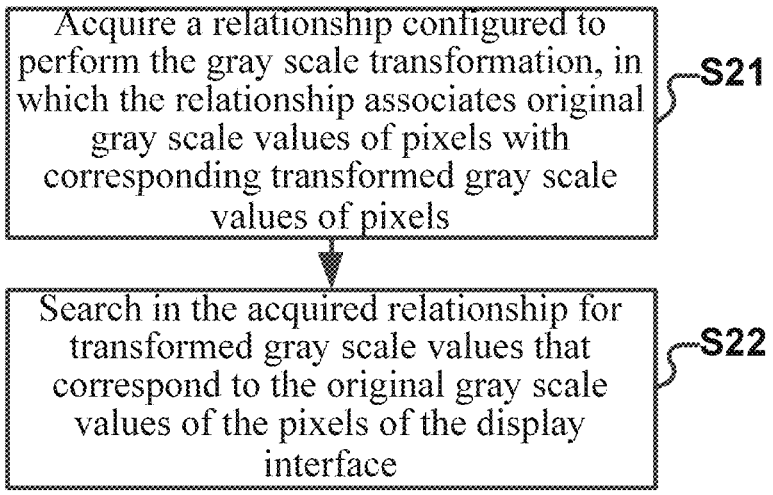
FIG. 2 is a flow chart showing a method for adjusting display brightness according to an example embodiment of the present disclosure.

FIG. 2 is a flow chart showing a method for adjusting display brightness according to another example embodiment of the present disclosure. As shown in FIG. 2, step S12 may include following steps.

In step S21, a relationship configured to perform the gray scale transformation is acquired, wherein the relationship associates original gray scale values of pixels with corresponding transformed gray scale values of pixels.

In step S22, transformed gray scale values that correspond to the original gray scale values of the pixels of the display are searched for in the acquired relationship.

Figure 3:
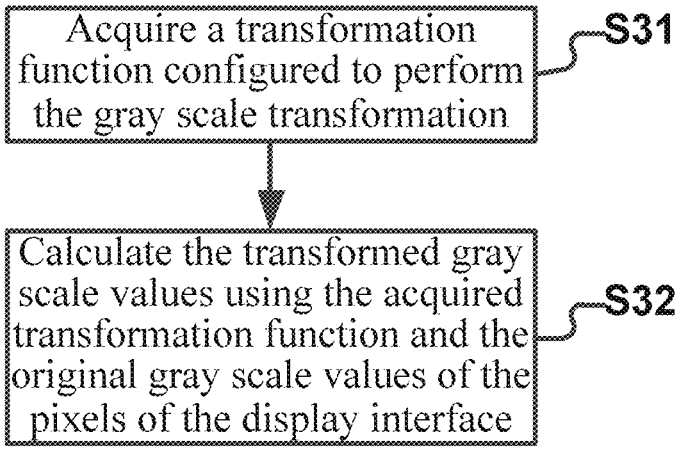
FIG. 3 is a flow chart showing a method for adjusting display brightness according to an example embodiment of the present disclosure.

FIG. 3 is a flow chart showing a method for adjusting display brightness according to another example embodiment of the present disclosure. As shown in FIG. 3, step S12 may include the following steps.

In step S31, a transformation function configured to perform the gray scale transformation is acquired.

In step S32, a respective transformed gray scale value of each pixel is calculated using the acquired transformation function and the respective original gray scale value of each pixel of the display.

In a solution, the relationship configured to perform the gray scale transformation may be set in advance, and respective transformed gray scale values corresponding to the respective original gray scale values of the pixels of the display may be searched for in the relationship. A transformation function configured to perform the gray scale transformation may also be pre-set in advance, and respective transformed gray scale values corresponding to the respective original gray scale values of the pixels of the display may be calculated using the transformation function and the original gray scale values of the pixels of the display. In this way, the transformed gray scale values may be determined quickly and accurately, and the brightness and contrast ratio of the display interface may be adjusted to adapt to the current ambient brightness, such that satisfactory image quality may be guaranteed without damaging the eyesight of the user.

The above relationship may include original gray scale values which are selected randomly and distributed evenly, along with respective corresponding transformed gray scale values. For example, if the original gray scale values are within a range of 0-255, the relationship may include only transformed gray scale values corresponding respectively to ten of the original gray scale values, as shown in following Table 1.

TABLE 1

| Original gray scale value | Transformed gray scale value |
|---|---|
| 0 | 0 |
| 25 | 20 |
| 65 | 45 |
| 95 | 55 |
| 135 | 75 |
| 175 | 95 |
| 190 | 105 |
| 210 | 125 |
| 235 | 155 |
| 255 | 170 |

A gray scale transformation curve may be fitted, for example according to a relationship such as the exemplary relationship in Table 1, and then respective transformed gray scale values corresponding to any original gray scale value may be obtained from the gray scale transformation curve.

Figure 4:
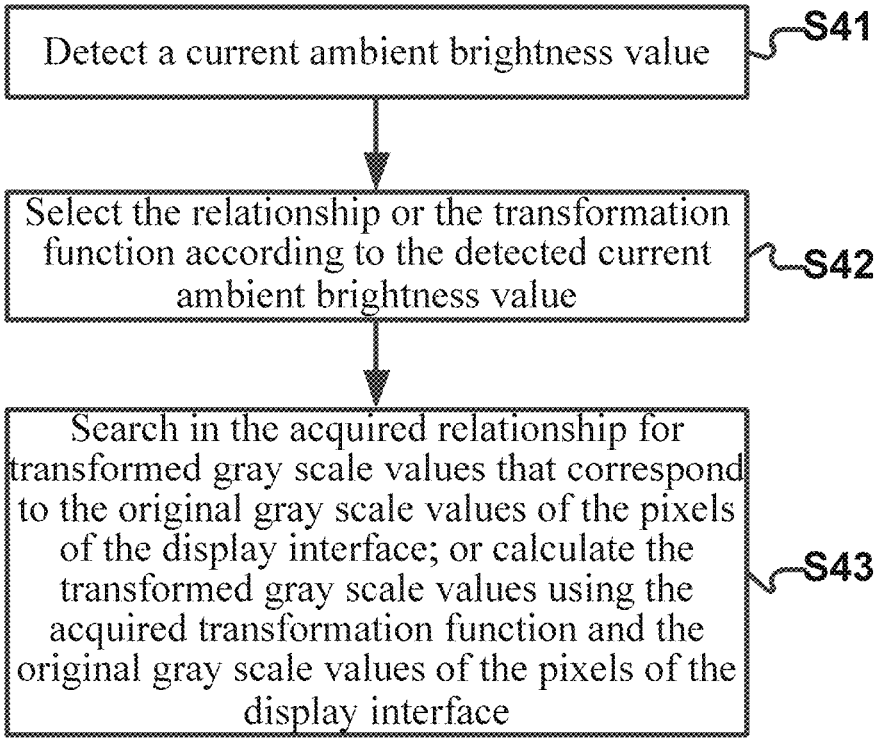
FIG. 4 is a flow chart showing a method for adjusting display brightness according to an example embodiment of the present disclosure.

FIG. 4 is a flow chart showing a method for adjusting display brightness according to another example embodiment of the present disclosure. As shown in FIG. 4, step S12 may include the following steps.

In step S41, a current ambient brightness value is detected.

In step S42, a relationship or transformation function is selected according to the detected current ambient brightness value.

In step S43, transformed gray scale values that correspond to the original gray scale values of the pixels of the display are searched for in the selected relationship, or transformed gray scale values are calculated using the acquired transformation function and the original gray scale values of the pixels of the display.

In a solution, the relationship or the transformation function configured to perform the gray scale transformation may be selected according to the detected ambient brightness. In other words, in different environment with different ambient brightness, different respective ways of transformation are adopted to adjust the gray scale values of the display interface. For example, when the ambient brightness is 0.001 lux, an exemplary relationship table A may be selected for performing the gray scale transformation. When the ambient brightness is 0.003 lux, a different exemplary relationship table B may be selected for performing the gray scale transformation, and the like. Under different ambient brightness levels, different objectives of adjusting gray scale values of the display interface are achieved. By selecting the relationship or the transformation function according to the detected ambient brightness, the brightness and contrast ratio of the display interface may always adapt to the current ambient brightness level, such that the eyesight of the user may be better protected, and the user satisfaction may be high.

Figure 5:
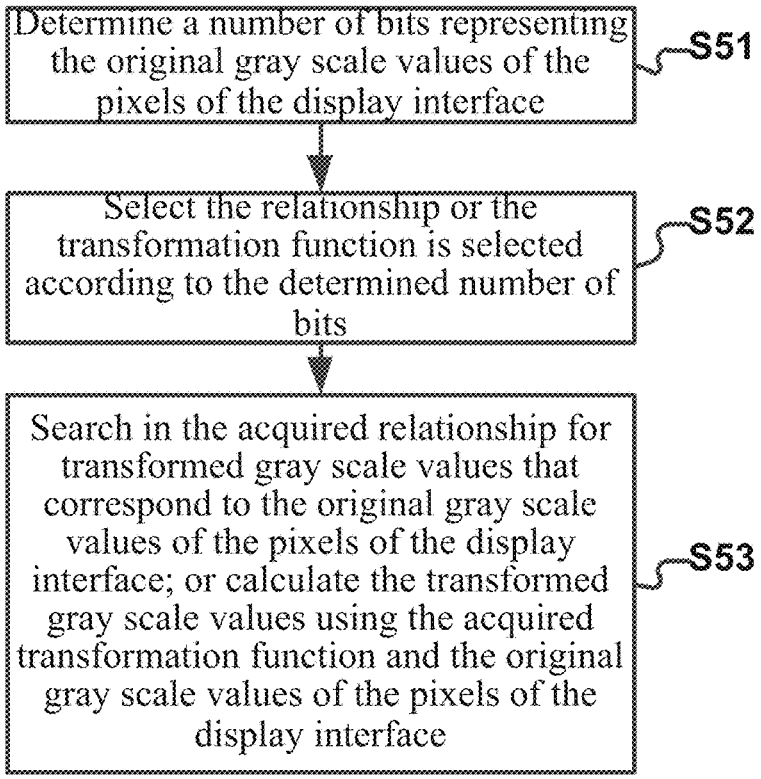
FIG. 5 is a flow chart showing a method for adjusting display brightness according to an example embodiment of the present disclosure.

FIG. 5 is a flow chart showing a method for adjusting display brightness according to another example embodiment of the present disclosure. As shown in FIG. 5, step S12 may include the following steps.

In step S51, the number of bits representing the original gray scale values is determined.

In step S52, the relationship or the transformation function is selected according to the determined number of bits.

In step S53, transformed gray scale values corresponding to the original gray scale values of the pixels of the display are searched for in the selected relationship, or transformed gray scale values are calculated using the transformation function and the original gray scale values of the pixels of the display.

In a solution, the relationship or the transformation function of the gray scale transformation may be selected according to the number of bits representing the original gray scale values. For example, if the original gray scale values are expressed by 8 bits, an exemplary relationship table A may be selected for performing the gray scale transformation. If the original gray scale values are expressed by 10 bits, a different exemplary table B may be selected for performing the gray scale transformation, and so on. In this way, the gray scale adjustment may adapt to display interfaces with varying display parameters, i.e. the gray scale adjustment may be performed using this method for applications with different display parameters, and thus the method may be widely applied.

Figure 6:
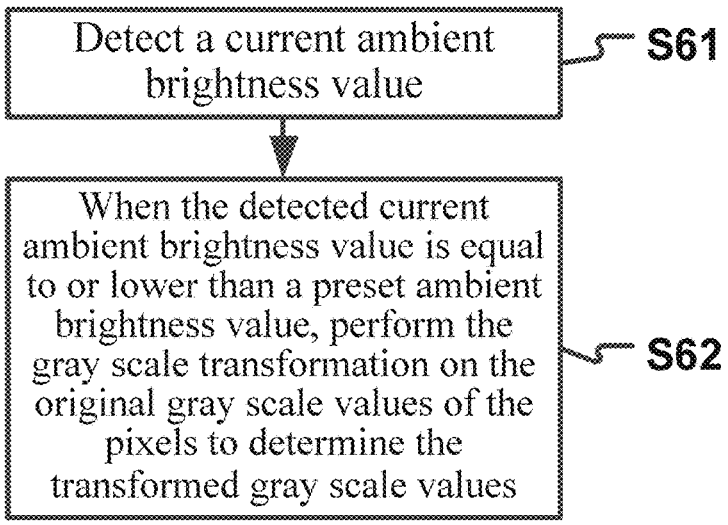
FIG. 6 is a flow chart showing a method for adjusting display brightness according to an example embodiment of the present disclosure.

FIG. 6 is a flow chart showing a method for adjusting display brightness according to another example embodiment of the present disclosure. As shown in FIG. 6, step S12 may include following steps.

In step S61, a current ambient brightness value is detected.

In step S62, when the detected current ambient brightness value is equal to or lower than a preset ambient brightness value, the gray scale transformation is performed on the original gray scale values to determine the transformed gray scale values.

In a solution, only when the ambient brightness is sufficiently low, for example when the ambient brightness is lower than or equals 0.1 lux, will the gray scale values of the display interface be adjusted, so that the gray scale values of the display interface are not too frequently adjusted to the ambient brightness. Thus the processing ability of the terminal may be conserved, the power consumption of the terminal may be reduced, and the user satisfaction may be high.

Figure 7A:
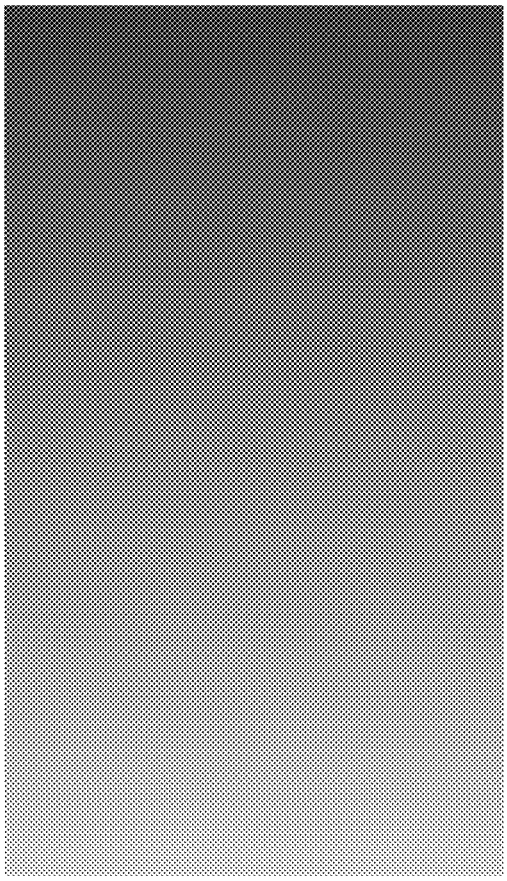
FIG. 7A is a schematic diagram illustrating an original display interface according to an example embodiment of the present disclosure.
Figure 7B:
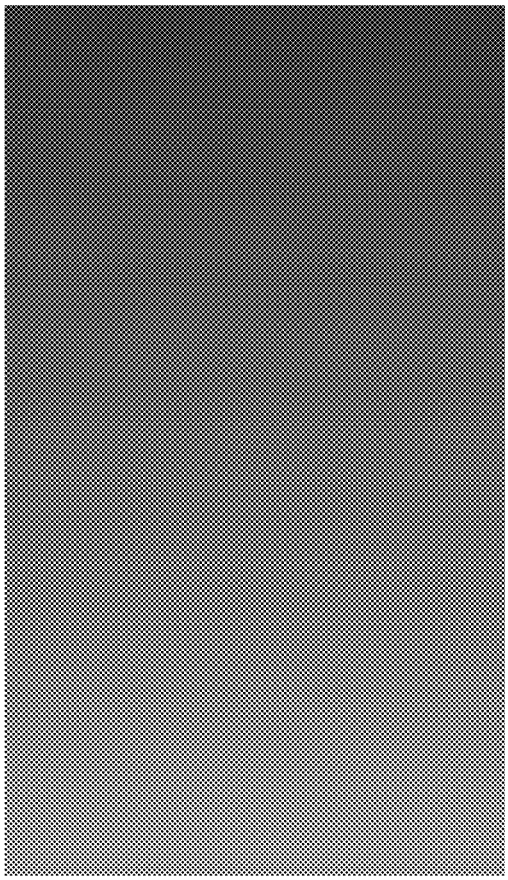
FIG. 7B is a schematic diagram illustrating a transformed display interface according to an example embodiment of the present disclosure.

As shown in FIG. 7A and FIG. 7B, the gray scale values of the bright part of the display interface may be decreased significantly, such that the backlight transmittance is reduced, the overall brightness is decreased significantly, and the contrast ratio of the image is decreased. In an environment with low brightness, image quality is less affected by a decline of the contrast ratio, such that image quality requirements of the user may be satisfied.

In a display processor (such as an application processor (AP) or digital display indicator control (DDIC)), a series of lookup tables may be set. Original gray scale values may be transformed according to a corresponding lookup table. Which lookup table is called may be determined according to the ambient brightness, and then the determined lookup table may be selected automatically or manually. The lookup table may be a set of digits, in which the content varies with the number of bits representing the gray scale values. If the gray scale values are expressed by 8 bits, the original gray scale values and the transformed gray scale values in the lookup table may be within a range of 0-255. If the gray scale values are expressed by 10 bits, the original gray scale values and the transformed gray scale values in the lookup table may be within a range of 0-1023.

Figure 8:
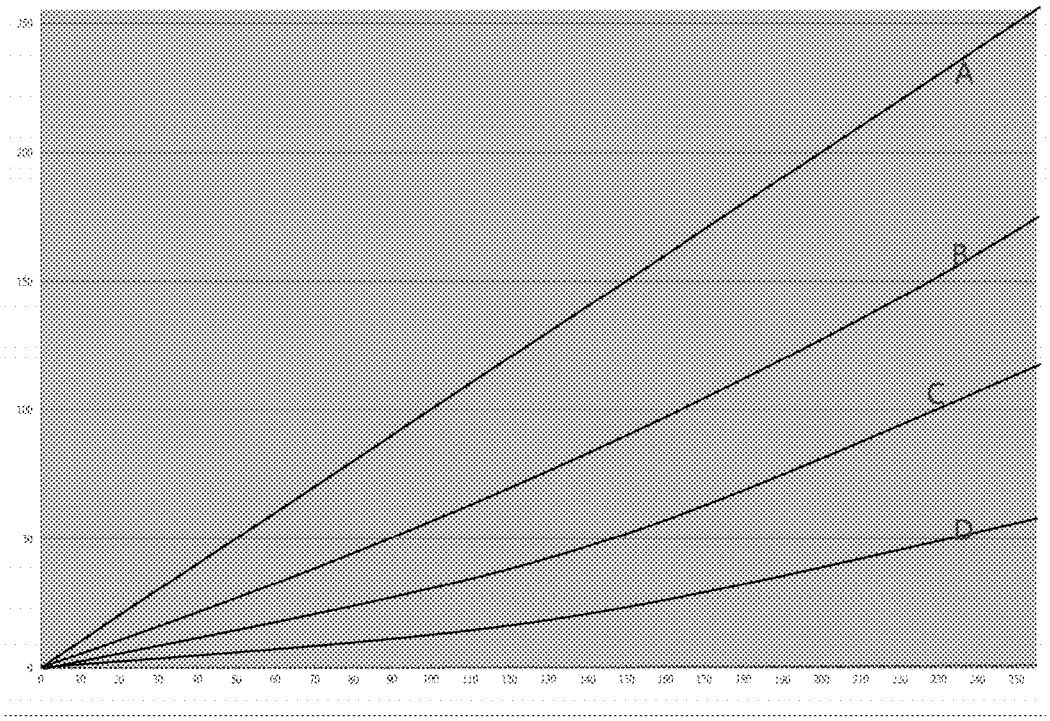
FIG. 8 is a schematic diagram illustrating a gray scale transformation curve according to an example embodiment of the present disclosure.

As shown in FIG. 8, for example, the original gray scale values may be expressed by a straight line A. If curve B is selected as the lookup table, then a gray scale value equal to 255 may be transformed into a gray scale value equal to 175, and the 256th entry in the lookup table may be (175/255) *255. A gray scale value equal to 150 may be transformed into a gray scale value equal to 90, and an entry corresponding to the gray scale value equal to 150 in the lookup table may be (90/255)*255. In a respective lookup table, the eighth power of 2 or the tenth power of 2 may be normalized.

Figure 9:
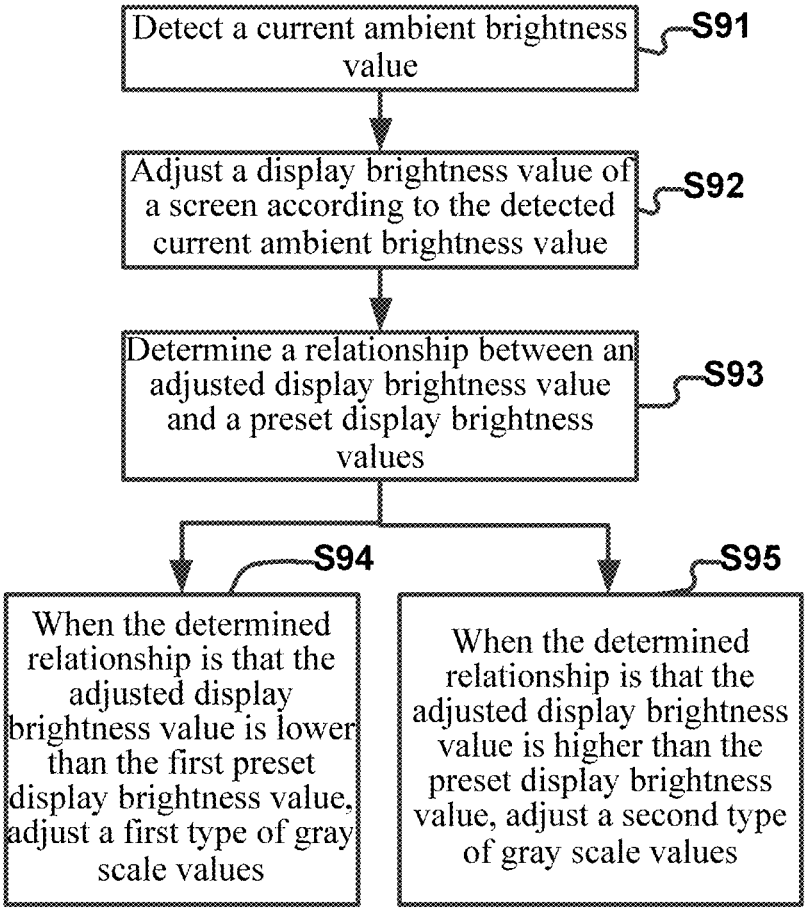
FIG. 9 is a flow chart showing a method for adjusting display brightness according to an example embodiment of the present disclosure.

FIG. 9 is a flow chart showing a method for adjusting display brightness according to another example embodiment of the present disclosure. As shown in FIG. 9, the method may further include the following steps.

In step S91, a current ambient brightness value is detected.

In step S92, a display brightness value of a screen is adjusted according to the current ambient brightness value.

In step S93, the relationship between an adjusted display brightness value and a preset display brightness value is determined.

In step S94, when the determined relationship is that the adjusted display brightness is lower than the first preset display brightness value, a first type of gray scale values is adjusted.

In step S95, when the determined relationship is that the adjusted display brightness is higher than the preset display brightness value, a second type of gray scale values is adjusted.

When ambient brightness is low, the terminal may first automatically adjust the display brightness of the screen, but the adjusted display brightness of the screen may still be too high for the user. Additionally, after the user opens some applications, the display brightness might return to a brightness equal to the brightness of the display before being adjusted, which may lead to low user satisfaction. In a solution, after the brightness of the screen is adjusted, the respective brightness at different positions on the screen is determined again, and then gray scale values of parts with different respective brightness are adjusted to varying respective degrees. As shown in FIG. 7A, the gray scale values of the upper part of the screen are low, i.e. the brightness is low, and thus it is not required to adjust the gray scale value. The gray scale values of the lower part of the screen are high, i.e. the brightness is high, and thus the terminal may adjust only the gray scale values of the lower part of the screen. In this way, the brightness of the display interface of the screen may be decreased efficiently for any situation, and an objective of protecting the eyesight of the user using the screen may be achieved.

Figure 10:
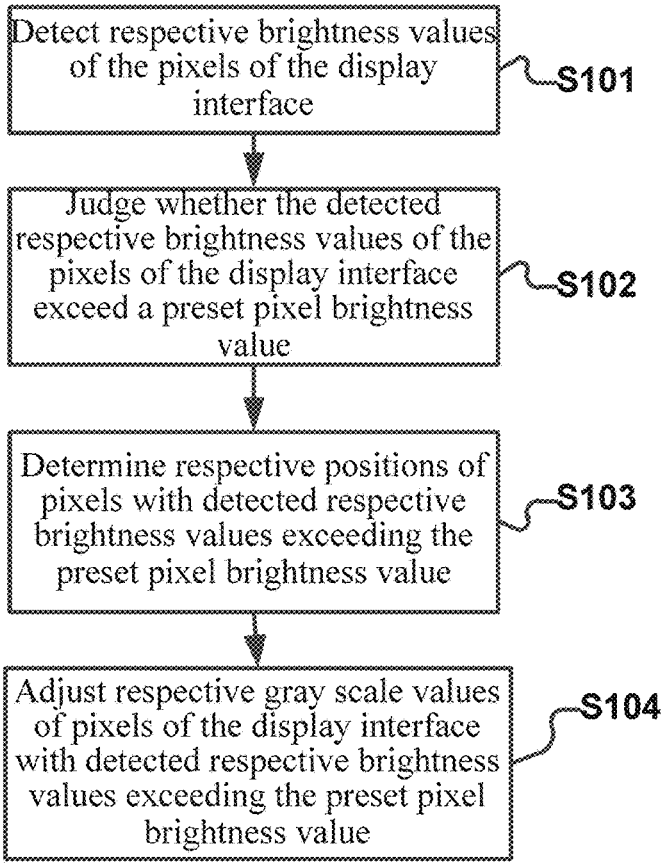
FIG. 10 is a flow chart showing a method for adjusting display brightness according to an example embodiment of the present disclosure.

FIG. 10 is a flow chart showing a method for adjusting display brightness according to another example embodiment of the present disclosure. As shown in FIG. 10, the method may further include, before acquiring original gray scale values of the pixels in the display interface, the following steps.

In step S101, respective brightness values of the pixels of the display interface are detected.

In step S102, it is judged whether the detected respective brightness values of the pixels of the display interface exceed a preset pixel brightness value.

In step S103, positions of pixels with detected respective brightness values exceeding the preset pixel brightness value are determined.

In step S104, respective gray scale values of pixels with detected respective brightness values exceeding the preset pixel brightness value are adjusted.

In a solution, the respective gray scale value of each pixel is adjusted according to the respective brightness of each pixel on the screen. In this way, the brightness of the display interface of the screen may be decreased quickly and effectively, and an objective of protecting the eyesight of the user using the screen may be achieved.

Figure 11:
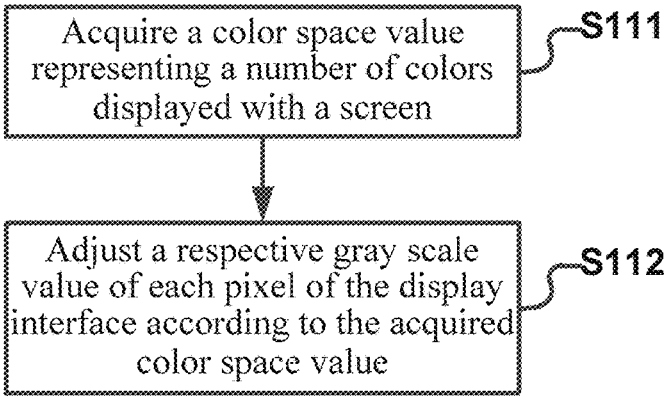
FIG. 11 is a flow chart showing a method for adjusting display brightness according to an example embodiment of the present disclosure.

FIG. 11 is a flow chart showing a method for adjusting display brightness according to another example embodiment of the present disclosure. As shown in FIG. 11, the method may further include the following steps.

In step S111, a color space value representing a number of colors displayed with the screen is determined.

In step S112, a respective gray scale value of each pixel on the display interface is adjusted according to the acquired color space value.

In a solution, the color space value (i.e. a value selected from a range consisting of the respective numbers of colors that the screen may display in various color modes) displayed on the screen is further acquired, and the gray scale values of the display interface are respectively adjusted according to different color space values. In this way, the brightness of the screen may be adjusted so as to fit the performance of the screen, such that the adjusting of the brightness may be more effective and the eyesight of the user may be protected.

Figure 12:
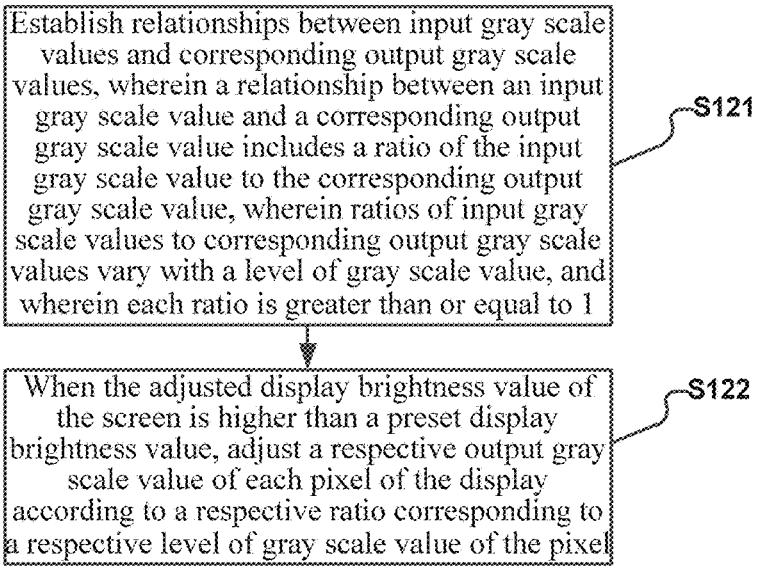
FIG. 12 is a flow chart showing a method for adjusting display brightness according to an example embodiment of the present disclosure.

FIG. 12 is a flow chart showing a method for adjusting display brightness according to another example embodiment of the present disclosure. As shown in FIG. 12, the method may further include the following steps.

In step S121, relationships are established between input gray scale values and corresponding output gray scale values, wherein a relationship between an input gray scale value and a corresponding output gray scale value includes a ratio of the input gray scale value to the corresponding output gray scale value, wherein ratios of input gray scale values to corresponding output gray scale values vary with a level of gray scale value, and wherein each ratio is greater than or equal to 1. Ratios may vary linearly or non-linearly.

In step S122, when the adjusted display brightness of the screen is higher than a preset display brightness value, a respective output gray scale value of each pixel on the display interface of the screen is adjusted according to a respective ratio corresponding to a respective level of gray scale value of the pixel.

In a solution, the relationships for adjusting the gray scale values may be preset, and the adjusted gray scale values of the screen may be lower than gray scale values before being adjusted, such that the brightness of the adjusted screen is decreased, thus protecting the eyesight of the user.

In this embodiment, in an environment with extremely low brightness, the display system operates with extremely low brightness, such that damage to the eyes may be reduced and the display system may adapt to an environment that has an extremely low brightness due to a lack of use of an illumination device.

Also, is the system may be effective for all displayed content rather than merely for some applications. Thus, it may be unnecessary to develop separate corresponding night modes for respective applications, such that the size of resource files may be reduced, storage space may be conserved, the operation may be easy to implement, and the user satisfaction may be high.

Figure 13:
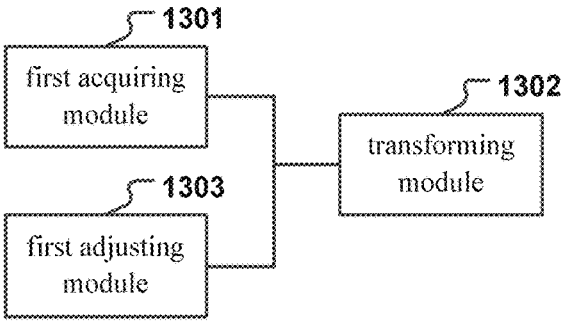
FIG. 13 is a block diagram showing a device for adjusting display brightness according to an example embodiment of the present disclosure.

FIG. 13 is a block diagram showing a device for adjusting display brightness according to an example embodiment of the present disclosure. As shown in FIG. 13, the device may include a first acquiring module 1301, a transforming module 1302, and a first adjusting module 1303.

The first acquiring module 1301 is configured to determine original gray scale values of pixels of a display interface.

The transforming module 1302 is configured to perform the gray scale transformation on the original gray scale values of the pixels of the display interface to obtain transformed gray scale values of the pixels.

The first adjusting module 1303 is configured to adjust gray scale values of the display interface to the transformed gray scale values of the pixels of the display interface.

Figure 14:
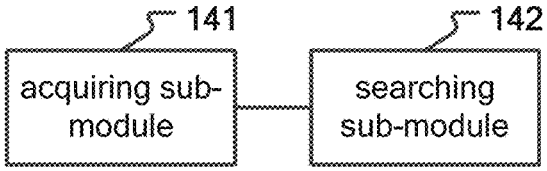
FIG. 14 is a block diagram of a transforming module according to an example embodiment.

FIG. 14 is a block diagram of a transforming module according to an example embodiment. As shown in FIG. 14, the transforming module 1302 may include an acquiring sub-module 141 and a searching sub-module 142.

The acquiring sub-module 141 is configured to acquire a relationship configured to perform the gray scale transformation, in which the relationship includes transformed gray scale values corresponding to original gray scale values.

The searching sub-module 142 is configured to search in the acquired relationship for transformed gray scale values corresponding to the original gray scale values of the pixels of the display interface.

Figure 15:
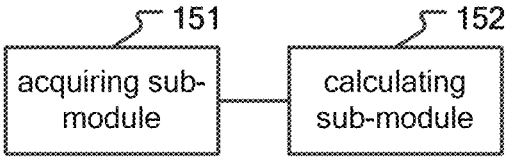
FIG. 15 is a block diagram of a transforming module according to an example embodiment.

FIG. 15 is a block diagram of a transforming module according to another example embodiment. As shown in FIG. 15, the transforming module 1302 may include an acquiring sub-module 151 and a calculating sub-module 152.

The acquiring sub-module 151 is configured to acquire a transformation function configured to be used in the gray scale transformation.

The calculating sub-module 152 is configured to calculate the transformed gray scale values using the acquired transformation function and the original gray scale values of the pixels.

Figure 16:
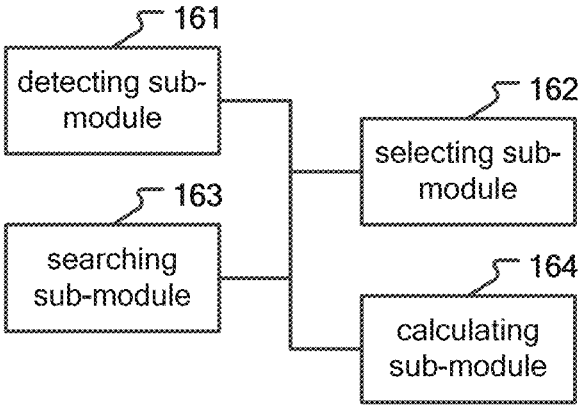
FIG. 16 is a block diagram of a transforming module according to an example embodiment.

FIG. 16 is a block diagram of a transforming module according to another example embodiment. As shown in FIG. 16, the transforming module 1302 may include a detecting sub-module 161, a selecting sub-module 162, and a searching sub-module 163 or a calculating sub-module 164.

The detecting sub-module 161 is configured to detect a current ambient brightness value.

The selecting sub-module 162 is configured to select the relationship or the transformation function configured to perform the gray scale transformation according to the current ambient brightness value.

The searching sub-module 163 is configured to search in the selected relationship for transformed gray scale values that correspond to the original gray scale values of the pixels of the display interface.

The calculating sub-module 164 is configured to calculate transformed gray scale values using the transformation function and the original gray scale values of the pixels of the display interface.

Figure 17:
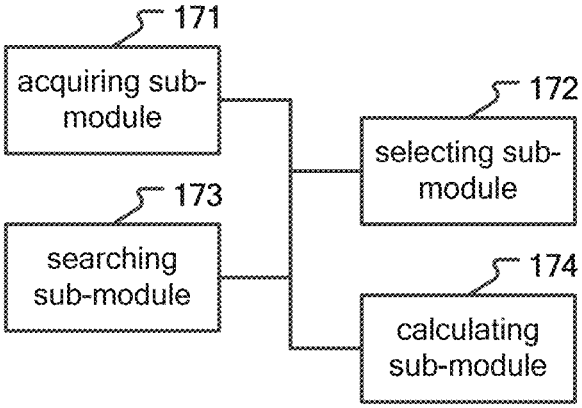
FIG. 17 is a block diagram of a transforming module according to an example embodiment.

FIG. 17 is a block diagram of a transforming module according to an example embodiment. As shown in FIG. 17, the transforming module 1302 may include an acquiring sub-module 171, a selecting sub-module 172, and a searching sub-module 173 or a calculating sub-module 174.

The acquiring sub-module 171 is configured to determine the number of bits representing the original gray scale values of the pixels of the display interface.

The selecting sub-module 172 is configured to select the relationship or the transformation function configured to perform the gray scale transformation according to the determined number of bits.

The searching sub-module 173 is configured to search in the acquired relationship for transformed gray scale values corresponding to the original gray scale values of the pixels of the display interface.

The calculating sub-module 174 is configured to calculate transformed gray scale values corresponding using the acquired transformation function and the original gray scale values of the pixels of the display interface.

Figure 18:
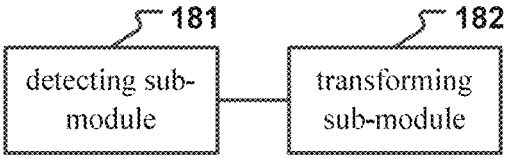
FIG. 18 is a block diagram of a transforming module according to an example embodiment.

FIG. 18 is a block diagram of a transforming module according to another example embodiment. As shown in FIG. 18, the transforming module 1302 may include a detecting sub-module 181 and a transforming sub-module 182.

The detecting sub-module 181 is configured to detect a current ambient brightness value.

The transforming sub-module 182 is configured to, when the detected current ambient brightness value is equal to or lower than a preset ambient brightness value, perform the gray scale transformation on the original gray scale values of the pixels to determine the transformed gray scale values.

Figure 19:
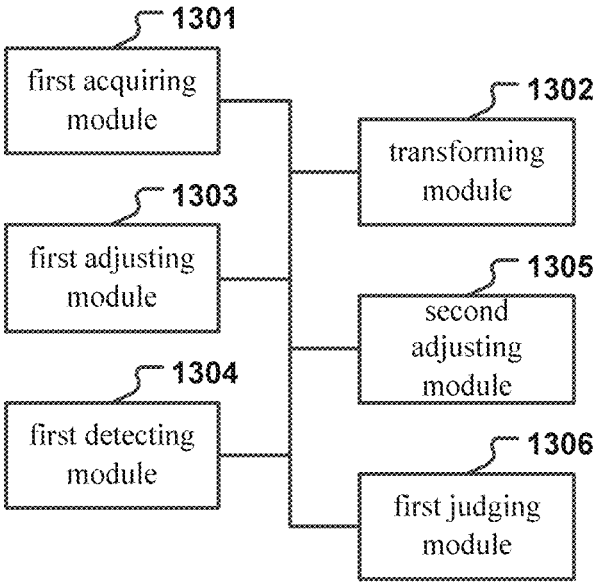
FIG. 19 is a block diagram showing a device for adjusting display brightness according to an example embodiment.

FIG. 19 is a block diagram showing a device for adjusting display brightness according to another example embodiment. As shown in FIG. 19, the device may further include a first detecting module 1304, a second adjusting module 1305, and a first judging module 1306.

The first detecting module 1304 is configured to detect a current ambient brightness value.

The second adjusting module 1305 is configured to adjust a display brightness value of a screen according to the detected current ambient brightness value.

The first judging module 1306 is configured to determine a relationship between an adjusted display brightness value and a preset display brightness values.

The first adjusting module 1303 is configured to, when the determined relationship is that the adjusted display brightness value is lower than the first preset display brightness value, adjust a first type of gray scale values, and to, when the determined relationship is that the adjusted display brightness value is higher than the preset display brightness value, adjust a second type of gray scale values.

Figure 20:
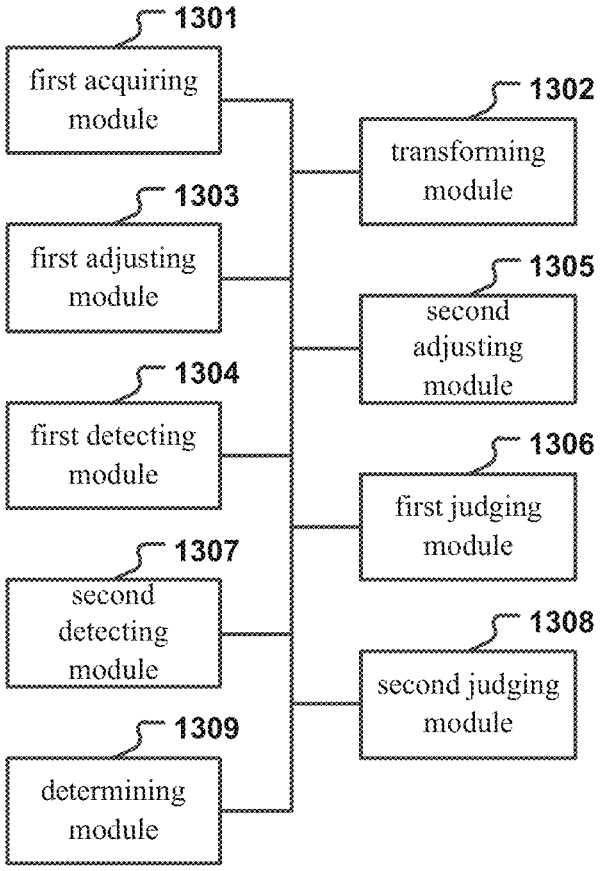
FIG. 20 is a block diagram showing a device for adjusting display brightness according to an example embodiment.

FIG. 20 is a block diagram showing a device for adjusting display brightness according to an example embodiment. As shown in FIG. 20, the device may further include a second detecting module 1307, a second judging module 1308 and a determining module 1309.

The second detecting module 1307 is configured to detect respective brightness values of the pixels of the display interface.

The second judging module 1308 is configured to judge whether the detected respective brightness values of the pixels of the display interface exceed a preset pixel brightness value.

The determining module 1309 is configured to determine respective positions of pixels with detected respective brightness values exceeding the preset pixel brightness value.

The first adjusting module 1303 is configured to adjust respective gray scale values of pixels of the display interface with detected respective brightness values exceeding the preset pixel brightness value.

Figure 21:
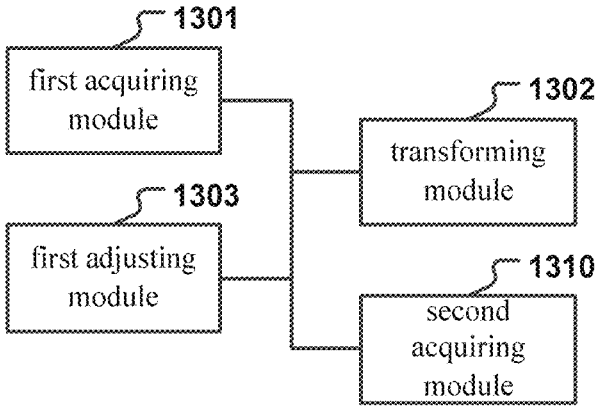
FIG. 21 is a block diagram showing a device for adjusting display brightness according to an example embodiment.

FIG. 21 is a block diagram showing a device for adjusting display brightness according to another example embodiment. As shown in FIG. 21, the device may further include a second acquiring module 1310.

The second acquiring module 1310 is configured to acquire a color space value representing a number of colors displayed with a screen.

The first adjusting module 1303 is configured to adjust a respective gray scale value of each pixel of the display interface according to the acquired color space value.

Figure 22:
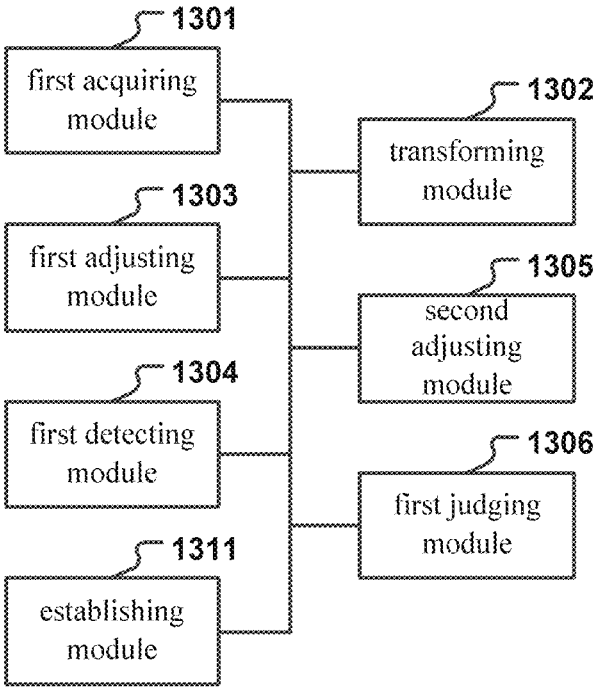
FIG. 22 is a block diagram showing a device for adjusting display brightness according to an example embodiment.

FIG. 22 is a block diagram showing a device for adjusting display brightness according to another example embodiment. As shown in FIG. 22, the device may further include an establishing module 1311.

The establishing module 1311 is configured establish relationships between input gray scale values and corresponding output gray scale values, in which a relationship between an input gray scale value and a corresponding output gray scale value includes a ratio of the input gray scale value to the corresponding output gray scale value, in which ratios of input gray scale values to corresponding output gray scale values vary with a level of gray scale value, and in which each ratio is greater than or equal to 1.

The first adjusting module 1303 is configured to when the adjusted display brightness value of the screen is higher than a preset display brightness value, adjust a respective output gray scale value of each pixel of the display interface according to a respective ratio corresponding to a respective level of gray scale value of the pixel.

With respect to the devices in the above embodiments, the specific manners for performing operations for individual modules therein have been described in detail in the embodiments regarding the methods for adjusting display brightness, and are not elaborated herein again.

There is provided a device for adjusting display brightness according to an example embodiment of the present disclosure. The device includes a processor, a memory configured to store an instruction executable by the processor.

The processor is configured to determine original gray scale values of pixels of a display interface. The processor is further configured to perform the gray scale transformation on the original gray scale values of the pixels of the display interface to determine transformed gray scale values. The processor is further configured to adjust gray scale values of the pixels of the display interface to the transformed gray scale values.

Figure 23:
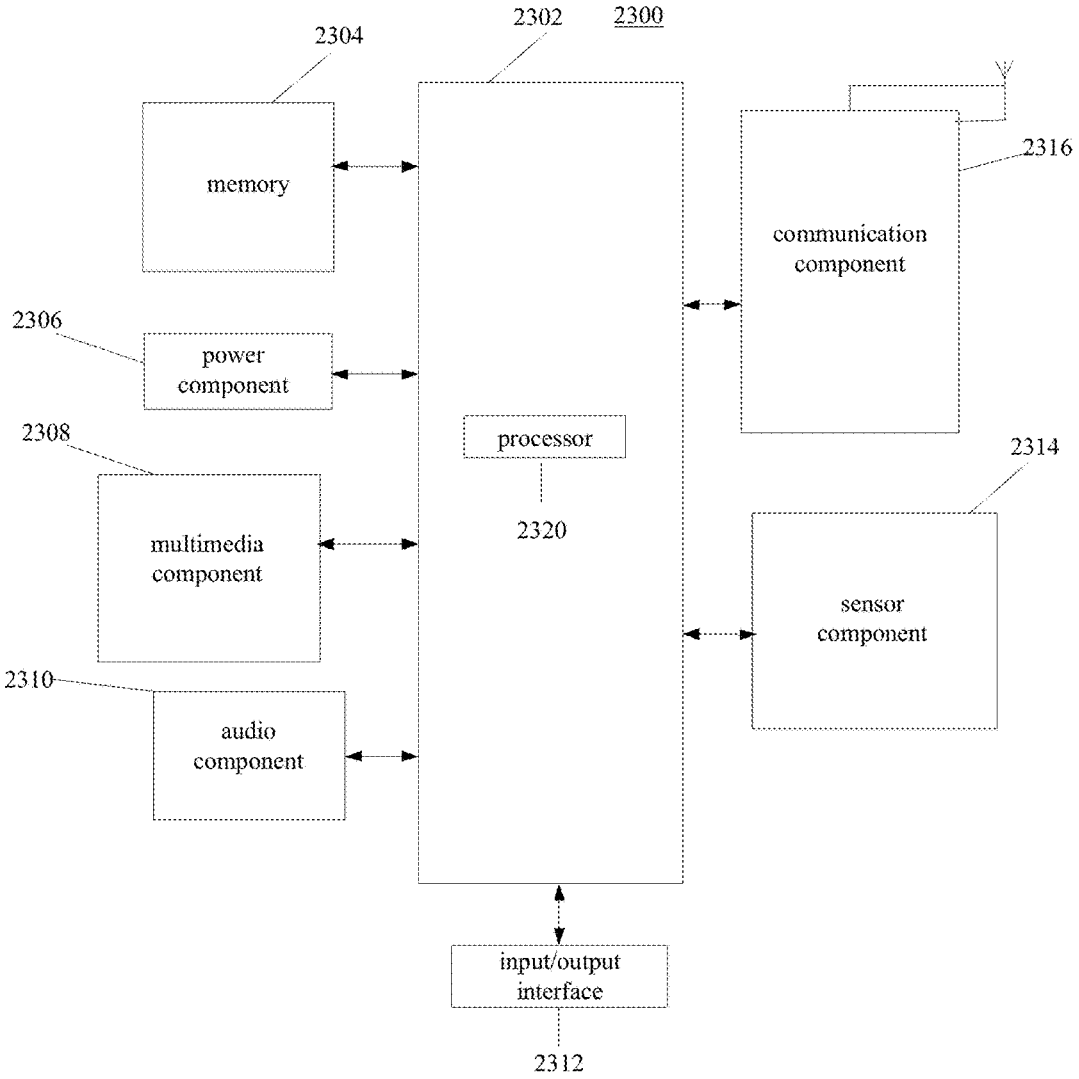
FIG. 23 is a block diagram showing a device for adjusting display brightness according to an example embodiment.

FIG. 23 is a block diagram showing a device 2300 for adjusting display brightness according to an example embodiment of the present disclosure. For example, the device 2300 may be a mobile phone, a computer, a digital broadcasting terminal, a message sending and receiving device, a game console, a flat panel device, a medical device, a fitness device, a personal digital assistant, or the like.

Referring to FIG. 23, the device 2300 may include one or more of the following components: a processing component 2302, a memory 2304, a power component 2306, a multimedia component 2308, an audio component 2310, an input/output (I/O) interface 2312, a sensor component 2314, and a communication component 2316.

The processing component 2302 typically controls overall operations of the device 2300, such as the operations associated with display, telephone calls, data communications, camera operations, and recording operations. The processing component 2302 may include one or more processors 2320 to execute instructions to perform all or part of the steps in the above described methods. Moreover, the processing component 2302 may include one or more modules which facilitate the interaction between the processing component 2302 and other components. For instance, the processing component 2302 may include a multimedia module to facilitate the interaction between the multimedia component 508 and the processing component 2302. The processing component 2302 may include each module discussed above, such as first acquiring module 1301, transforming module 1302, first adjusting module 1303, acquiring sub-module 141, searching sub-module 142, acquiring sub-module 151, calculating submodule 152, detecting sub-module 161, selecting sub-module 162, searching sub-module 163, calculating sub-module 164, acquiring sub-module 171, selecting sub-module 172, searching sub-module 173, calculating sub-module 174, detecting sub-module 181, transforming sub-module 182, first acquiring module 1301, transforming module 1302, first adjusting module 1303, first detecting module 1304, second adjusting module 1305, first judging module 1306, second detecting module 1307, second judging module 1308, determining module 1309, second acquiring module 1310, and/or establishing module 1311.

The memory 2304 is configured to store various types of data to support the operation of the device 2300. Examples of such data include instructions for any applications or methods operated on the device 2300, contact data, phonebook data, messages, pictures, video, etc. The memory 2304 may be implemented using any type of volatile or non-volatile memory devices, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power component 2306 provides power to various components of the device 2300. The power component 2306 may include a power management system, one or more power sources, and any other components associated with the generation, management, and distribution of power in the device 2300.

The multimedia component 2308 includes a screen providing an output interface between the device 2300 and the user. In some embodiments, the screen may include a liquid crystal display (LCD) and a touch panel (TP). If the screen includes the touch panel, the screen may be implemented as a touch screen to receive input signals from the user. The touch panel includes one or more touch sensors to sense touches, swipes, and gestures on the touch panel. The touch sensors may not only sense a boundary of a touch or swipe action, but also sense a period of time and a pressure associated with the touch or swipe action. In some embodiments, the multimedia component 2308 includes a front camera and/or a rear camera. The front camera and the rear camera may receive an external multimedia datum while the device 2300 is in an operation mode, such as a photographing mode or a video mode. Each of the front camera and the rear camera may be a fixed optical lens system or have focus and optical zoom capability.

The audio component 2310 is configured to output and/or input audio signals. For example, the audio component 2310 includes a microphone (MIC) configured to receive an external audio signal when the device 2300 is in an operation mode, such as a call mode, a recording mode, and a voice recognition mode. The received audio signal may be further stored in the memory 2304 or transmitted via the communication component 2316. In some embodiments, the audio component 2310 further includes a speaker to output audio signals.

The I/O interface 2312 provides an interface between the processing component 2302 and peripheral interface modules, such as a keyboard, a click wheel, buttons, and the like. The buttons may include, but are not limited to, a home button, a volume button, a starting button, and a locking button.

The sensor component 2314 includes one or more sensors to provide status assessments of various aspects of the device 2300. For instance, the sensor component 2314 may detect an open/closed status of the device 2300, relative positioning of components, e.g., the display and the keypad, of the device 2300, a change in position of the device 2300 or a component of the device 2300, a presence or absence of user contact with the device 2300, an orientation or an acceleration/deceleration of the device 2300, and a change in temperature of the device 2300. The sensor component 2314 may include a proximity sensor configured to detect the presence of nearby objects without any physical contact. The sensor component 2314 may also include a light sensor, such as a CMOS or CCD image sensor, for use in imaging applications. In some embodiments, the sensor component 2314 may also include an accelerometer sensor, a gyroscope sensor, a magnetic sensor, a pressure sensor, or a temperature sensor.

The communication component 2316 is configured to facilitate communication, wired or wirelessly, between the device 2300 and other devices. The device 2300 can access a wireless network based on a communication standard, such as WiFi, 2G, or 3G, or a combination thereof. In one exemplary embodiment, the communication component 2316 receives a broadcast signal or broadcast associated information from an external broadcast management system via a broadcast channel. In one exemplary embodiment, the communication component 2316 further includes a near field communication (NFC) module to facilitate short-range communications. For example, the NFC module may be implemented based on a radio frequency identification (RFID) technology, an infrared data association (IrDA) technology, an ultra-wideband (UWB) technology, a Bluetooth (BT) technology, and other technologies.

In exemplary embodiments, the device 2300 may be implemented with one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components, for performing the above described methods.

Each module discussed above, such as first acquiring module 1301, transforming module 1302, first adjusting module 1303, acquiring sub-module 141, searching sub-module 142, acquiring sub-module 151, calculating sub-module 152, detecting sub-module 161, selecting sub-module 162, searching sub-module 163, calculating sub-module 164, acquiring sub-module 171, selecting sub-module 172, searching sub-module 173, calculating sub-module 174, detecting sub-module 181, transforming sub-module 182, first acquiring module 1301, transforming module 1302, first adjusting module 1303, first detecting module 1304, second adjusting module 1305, first judging module 1306, second detecting module 1307, second judging module 1308, determining module 1309, second acquiring module 1310, and establishing module 1311, may take the form of a packaged functional hardware unit designed for use with other components, a portion of a program code (e.g., software or firmware) executable by the processors 2320 or the processing circuitry that usually performs a particular function of related functions, or a self-contained hardware or software component that interfaces with a larger system, for example.

In exemplary embodiments, there is also provided a non-transitory computer-readable storage medium including instructions, such as included in the memory 2304, executable by the processor 2320 in the device 2300, for performing the above-described methods. For example, the non-transitory computer-readable storage medium may be a ROM, a RAM, a CD-ROM, a magnetic tape, a floppy disc, an optical data storage device, and the like.

A non-temporary computer-readable storage medium is provided. The storage medium has stored therein instructions for adjusting display brightness. The instructions are configured to, when executed by the processor of the mobile terminal, cause the mobile terminal to determine original gray scale values of pixels of a display interface of the mobile terminal. The instructions are further configured to, when executed by the processor of the mobile terminal, cause the mobile terminal to perform gray scale transformation on the original gray scale values of the pixels of the display interface to determine transformed gray scale values. The instructions are further configured to, when executed by the processor of the mobile terminal, cause the mobile terminal to adjust gray scale values of the pixels of the display to the transformed gray scale values. The instructions may be further configured to, when executed by the processor of the mobile terminal, cause the mobile terminal to perform any of the method steps of this disclosure, including, steps such as S11, S12, S13, S21, S22, S31, S41, S42, S43, S51, S52, S53, S61, S62, S91, S92, S93, S94, S95, S101, S102, S103, S104, S111, S112, S121, and/or S122.

The methods, devices, and modules described above may be implemented in many different ways and as hardware, software or in different combinations of hardware and software. For example, all or parts of the implementations may be a processing circuitry that includes an instruction processor, such as a central processing unit (CPU), microcontroller, a microprocessor; or application specific integrated circuits (ASICs), digital signal processors (DSPs), digital signal processing devices (DSPDs), programmable logic devices (PLDs), field programmable gate arrays (FPGAs), controllers, micro-controllers, microprocessors, other electronic components; or as circuitry that includes discrete logic or other circuit components, including analog circuit components, digital circuit components or both; or any combination thereof. The circuitry may include discrete interconnected hardware components or may be combined on a single integrated circuit die, distributed among multiple integrated circuit dies, or implemented in a Multiple Chip Module (MCM) of multiple integrated circuit dies in a common package, as examples.

Other embodiments of the disclosure will be apparent to those skilled in the art from consideration of the specification and practice of the disclosure disclosed here. This application is intended to cover any variations, uses, or adaptations of the disclosure following the general principles thereof and including such departures from the present disclosure as come within known or customary practice in the art. It is intended that the specification and examples be considered as exemplary only, with a true scope and spirit of the disclosure being indicated by the following claims.

It will be appreciated that the present disclosure is not limited to the exact construction that has been described above and illustrated in the accompanying drawings, and that various modifications and changes can be made without departing from the scope thereof. It is intended that the scope of the disclosure only be limited by the appended claims.

What is claimed is:

1. A method for adjusting display brightness, comprising:

determining original gray scale values of pixels of a display;

performing gray scale transformation on the original gray scale values of the pixels of the display to determine transformed gray scale values;

adjusting gray scale values of the pixels of the display to the transformed gray scale values;

detecting a current ambient brightness value;

adjusting a display brightness value of a screen according to the detected current ambient brightness value;

re-determining respective brightness at different positions on the display after the brightness of the screen is adjusted; and re-adjusting gray scale values of parts on the display with different respective brightness to varying respective degrees according to a relationship between an input gray scale value and a corresponding output gray scale value including a ratio of the input gray scale value to the corresponding output gray scale value, wherein each ratio is greater than or equal to 1, and when the adjusted display brightness value of the screen is higher than a preset display brightness value, a respective output gray scale value of each pixel of the display is adjusted according to a respective ratio corresponding to a respective level of gray scale value of the pixel.

2. The method according to claim 1, wherein performing gray scale transformation on the original gray scale values of the pixels of the display to determine transformed gray scale values comprises:

acquiring a relationship configured to perform the gray scale transformation, wherein the relationship associates original gray scale values of pixels with corresponding transformed gray scale values of pixels; and searching in the acquired relationship for transformed gray scale values that correspond to the original gray scale values of the pixels of the display.

3. The method according to claim 2, wherein performing gray scale transformation on the original gray scale values of the pixels of the display to determine transformed gray scale values comprises:

selecting the relationship according to the detected current ambient brightness value; and searching in the selected relationship for transformed gray scale values that correspond to the original gray scale values of the pixels on the display.

4. The method according to claim 2, wherein performing gray scale transformation on the original gray scale values of the pixels of the display to determine transformed gray scale values comprises:

determining a number of bits representing the original gray scale values of the pixels of the display;

selecting the relationship for the gray scale transformation according to the determined number of bits; and searching in the selected relationship for transformed gray scale values that correspond to the original gray scale values of the pixels on the display.

5. The method according to claim 1, wherein performing gray scale transformation on the original gray scale values of the pixels of the display to determine transformed gray scale values comprises:

acquiring a transformation function configured to perform the gray scale transformation; and calculating the transformed gray scale values using the acquired transformation function and the original gray scale values of the pixels of the display.

6. The method according to claim 5, wherein performing gray scale transformation on the original gray scale values of the pixels of the display to determine transformed gray scale values comprises:

selecting the transformation function for the gray scale transformation according to the detected current ambient brightness value; and calculating the transformed gray scale values using the selected transformation function and the original gray scale values of the pixels of the display.

7. The method according to claim 5, wherein performing gray scale transformation on the original gray scale values of the pixels of the display to determine transformed gray scale values comprises:

determining a number of bits representing the original gray scale values of the pixels of the display;

selecting the transformation function for the gray scale transformation according to the determined number of bits; and calculating the transformed gray scale values using the selected transformation function and the original gray scale values of the pixels of the display.

8. The method according to claim 1, wherein performing gray scale transformation on the original gray scale values of the pixels of the display to determine transformed gray scale values comprises:

when the detected current ambient brightness value is equal to or lower than a preset ambient brightness value, performing the gray scale transformation on the original gray scale values of the pixels of the display to determine the transformed gray scale values.

9. The method according to claim 1, further comprising:

determining a relationship between an adjusted display brightness value and the preset display brightness values;

when the determined relationship is that the adjusted display brightness value is lower than a first preset display brightness value, adjusting a first type of gray scale values; and when the determined relationship is that the adjusted display brightness value is higher than the preset display brightness value, adjusting a second type of gray scale values.

10. The method according to claim 9 further comprising:

detecting respective brightness values of the pixels of the display;

judging whether the detected respective brightness values of the pixels of the display exceed a preset pixel brightness value;

determining respective positions of pixels with detected respective brightness values exceeding the preset pixel brightness value; and adjusting respective gray scale values of pixels of the display with detected respective brightness values exceeding the preset pixel brightness value.

11. The method according to claim 1, further comprising:

acquiring a color space value representing a number of colors displayed with a screen; and adjusting a respective gray scale value of each pixel of the display according to the acquired color space value.

12. The method according to claim 9, further comprising:

establishing relationships between the input gray scale values and the corresponding output gray scale values, wherein ratios of input gray scale values to corresponding output gray scale values vary with a level of gray scale value.

13. A device for adjusting display brightness, comprising:

a processor; and a memory in communication with the processor, configured to store instructions executable by the processor;

wherein the processor is configured to:

determine original gray scale values of pixels of a display;

perform gray scale transformation on the original gray scale values of the pixels of the display to determine transformed gray scale values;

adjust gray scale values of the pixels of the display to the transformed gray scale values;

detect a current ambient brightness value;

adjust a display brightness value of a screen according to the detected current ambient brightness value;

re-determine respective brightness at different positions on the display after the brightness of the screen is adjusted; and re-adjust gray scale values of parts on the display with different respective brightness to varying respective degrees according to a relationship between an input gray scale value and a corresponding output gray scale value including a ratio of the input gray scale value to the corresponding output gray scale value, wherein each ratio is greater than or equal to 1, and when the adjusted display brightness value of the screen is higher than a preset display brightness value, a respective output gray scale value of each pixel of the display is adjusted according to a respective ratio corresponding to a respective level of gray scale value of the pixel.

14. The device according to claim 13, wherein the processor is further configured to:

acquire a relationship configured to perform the gray scale transformation, wherein the relationship associates original gray scale values of pixels with corresponding transformed gray scale values of pixels; and search in the acquired relationship for transformed gray scale values that correspond to the original gray scale values of the pixels of the display.

15. The device according to claim 14, wherein the processor is further configured to:

select the relationship according to the detected current ambient brightness value; and search in the selected relationship for transformed gray scale values that correspond to the original gray scale values of the pixels of the display.

16. The device according to claim 14, wherein the processor is further configured to:

determine a number of bits representing the original gray scale values of the pixels of the display;

select the relationship for the gray scale transformation according to the determined number of bits; and search in the selected relationship for transformed gray scale values that correspond to the original gray scale values of the pixels of the display.

17. The device according to claim 13, wherein the processor is further configured to:

acquire a transformation function configured to perform the gray scale transformation; and calculate the transformed gray scale values using the acquired transformation function and the original gray scale values of the pixels of the display.

18. The device according to claim 17, wherein the processor is further configured to:

select the transformation function for the gray scale transformation according to the detected current ambient brightness value; and calculate the transformed gray scale values using the selected transformation function and the original gray scale values of the pixels of the display.

19. The device according to claim 17, wherein the processor is further configured to:

determine a number of bits representing the original gray scale values of the pixels of the display;

select the transformation function for the gray scale transformation according to the determined number of bits; and calculate the transformed gray scale values using the selected transformation function and the original gray scale values of the pixels of the display.

20. The device according to claim 13, wherein the processor is further configured to:

when the detected current ambient brightness value is equal to or lower than a preset ambient brightness value, perform the gray scale transformation on the original gray scale values of the pixels to determine the transformed gray scale values.

21. The device according to claim 13, wherein the processor is further configured to:

determine a relationship between an adjusted display brightness value and a preset display brightness values;

when the determined relationship is that the adjusted display brightness value is lower than a first preset display brightness value, adjust a first type of gray scale values; and when the determined relationship is that the adjusted display brightness value is higher than the preset display brightness value, adjust a second type of gray scale values.

22. The device according to claim 21, wherein the processor is further configured to:

detect respective brightness values of the pixels of the display;

judge whether the detected respective brightness values of the pixels of the display exceed a preset pixel brightness value;

determine respective positions of pixels with detected respective brightness values exceeding the preset pixel brightness value; and adjust respective gray scale values of pixels of the display with detected respective brightness values exceeding the preset pixel brightness value.

23. The device according to claim 13, wherein the processor is further configured to:

acquire a color space value representing a number of colors displayed with a screen; and adjust a respective gray scale value of each pixel of the display according to the acquired color space value.

24. The device according to claim 21, wherein the processor is further configured to:

establish relationships between input gray scale values and corresponding output gray scale values, wherein ratios of input gray scale values to corresponding output gray scale values vary with a level of gray scale value.

25. A non-transitory computer-readable storage medium having stored therein instructions for adjusting display brightness, the instructions configured to, when executed by a processor of a device, cause the device to:

determine original gray scale values of pixels of a display;

perform gray scale transformation on the original gray scale values of the pixels of the display to determine transformed gray scale values;

adjust gray scale values of the pixels of the display to the transformed gray scale values;

detect a current ambient brightness value;

adjust a display brightness value of a screen according to the detected current ambient brightness value;

re-determine respective brightness at different positions on the display after the brightness of the screen is adjusted; and re-adjust gray scale values of parts on the display with different respective brightness to varying respective degrees according to a relationship between an input gray scale value and a corresponding output gray scale value including a ratio of the input gray scale value to the corresponding output gray scale value, wherein each ratio is greater than or equal to 1, and when the adjusted display brightness value of the screen is higher than a preset display brightness value, a respective output gray scale value of each pixel of the display is adjusted according to a respective ratio corresponding to a respective level of gray scale value of the pixel.

* * * * *